US007475640B2

(12) United States Patent
Winter et al.

(10) Patent No.: US 7,475,640 B2
(45) **Date of Patent: *Jan. 13, 2009**

(54) PERSONAL TABLE

(75) Inventors: David C. Winter, Layton, UT (US); Jay Jones, Clearfield, UT (US); Stephen F. Nye, Syracuse, UT (US); Brandon Smith, South Ogden, UT (US); Kent Ashby, Logan, UT (US); L. Curtis Strong, Clearfield, UT (US); S. Curtis Nye, Clinton, UT (US); Thayne B. Haney, Syracuse, UT (US); Jy-Young Jin, Fujian (CN)

(73) Assignee: Lifetime Products, Inc., Clearfield, UT (US)

( * ) Notice: Subject to any disclaimer, the term of this patent is extended or adjusted under 35 U.S.C. 154(b) by 188 days.

This patent is subject to a terminal disclaimer.

(21) Appl. No.: 11/372,966

(22) Filed: Mar. 10, 2006

(65) Prior Publication Data

US 2006/0243176 A1 Nov. 2, 2006

Related U.S. Application Data

(63) Continuation-in-part of application No. 11/038,375, filed on Jan. 18, 2005, now Pat. No. 7,263,932, and a continuation-in-part of application No. 10/340,018, filed on Jan. 9, 2003, now Pat. No. 6,912,961, which is a continuation-in-part of application No. 29/167,624, filed on Sep. 18, 2002, now Pat. No. Des. 469,994, and a continuation-in-part of application No. 29/167,611, filed on Sep. 18, 2002, now Pat. No. Des. 470,352, application No. 11/372,966, which is a continuation-in-part of application No. 10/692,892, filed on Oct. 24, 2003, now Pat. No. 7,059,256, which is a continuation-in-part of application No. 10/340,018, filed on Jan. 9, 2003, now Pat. No. 6,912,961, and a continuation-in-part of application No. 29/176,792, filed on Feb. 26, 2003, now Pat. No. Des. 485,100, and a continuation-in-part of application No. 29/176,842, filed on Feb. 26, 2003, now Pat. No. Des. 485,719, and a continuation-in-part of application No. 29/176,841, filed on Feb. 26, 2003, now Pat. No. Des. 481,567.

(60) Provisional application No. 60/660,526, filed on Mar. 10, 2005, provisional application No. 60/364,712, filed on Mar. 14, 2002, provisional application No. 60/421,221, filed on Oct. 25, 2002, provisional application No. 60/347,556, filed on Jan. 9, 2002.

(51) Int. Cl.
*A47B 3/02* (2006.01)

(52) U.S. Cl. ..... 108/118; 108/116

(58) Field of Classification Search ..... 108/118, 108/116, 115, 119, 120, 132; 248/188.2, 248/188.6, 188.1, 439, 161, 423, 157, 164, 248/168

See application file for complete search history.

(56) References Cited

U.S. PATENT DOCUMENTS

| | | | | |
|---|---|---|---|---|
| 544,603 | A | | 8/1895 | Thompson |
| 2,675,286 | A | | 4/1954 | Derman |
| 2,692,807 | A | | 10/1954 | Cordola |
| D175,939 | S | | 11/1955 | Gettelman |
| 2,834,644 | A | * | 6/1958 | Johansson et al. ..... 108/155 |
| 2,857,228 | A | | 10/1958 | Koett |
| 2,879,118 | A | | 3/1959 | Kolb |
| 2,912,775 | A | | 11/1959 | Gettelman |
| 3,031,243 | A | | 4/1962 | Crenoi |
| 3,094,948 | A | | 6/1963 | Clow |
| 3,108,550 | A | | 10/1963 | Knoblock |
| 3,224,389 | A | * | 12/1965 | Kent ..... 108/119 |
| 3,247,811 | A | | 4/1966 | Bauder |
| 3,405,587 | A | | 10/1968 | Meazzi et al. |
| 3,685,824 | A | | 8/1972 | Quinn |
| 3,906,848 | A | * | 9/1975 | Gow ..... 99/339 |
| 3,954,068 | A | | 5/1976 | Roberts et al. |
| 4,099,469 | A | | 7/1978 | Sahli |
| 4,105,271 | A | | 8/1978 | Sebel et al. |
| 4,168,669 | A | * | 9/1979 | Arnoff ..... 108/116 |
| 4,196,675 | A | | 4/1980 | Cook |
| 4,248,161 | A | | 2/1981 | Adair et al. |
| 4,433,869 | A | | 2/1984 | Payne et al. |

| | | | | | |
|---|---|---|---|---|---|
| 4,944,235 | A | | 7/1990 | Jahnke et al. | |
| 4,951,576 | A | | 8/1990 | Cobos et al. | |
| 5,086,711 | A | | 2/1992 | Matthews | |
| 5,272,825 | A | | 12/1993 | Simpson | |
| 5,353,715 | A | | 10/1994 | Luyk | |
| 5,358,204 | A | | 10/1994 | Terada | |
| D353,286 | S | | 12/1994 | Hand | |
| D355,091 | S | | 2/1995 | Green et al. | |
| 5,394,808 | A | | 3/1995 | Dutro et al. | |
| D358,954 | S | | 6/1995 | Leduc | |
| 5,465,673 | A | | 11/1995 | Ma | |
| 5,483,901 | A | * | 1/1996 | Tisbo et al. | 108/119 |
| D366,781 | S | | 2/1996 | Cartwright | |
| 5,509,360 | A | | 4/1996 | Chiu | |
| 5,603,267 | A | | 2/1997 | Soper | |
| 5,644,994 | A | | 7/1997 | Liang et al. | |
| 5,848,822 | A | * | 12/1998 | Wu | 108/119 |
| D412,831 | S | | 8/1999 | Murakami | |
| D416,148 | S | | 11/1999 | Pagnon et al. | |
| 6,019,050 | A | | 2/2000 | Ranta | |
| 6,112,674 | A | | 9/2000 | Stanford | |
| 6,327,800 | B1 | | 12/2001 | Daams | |
| D452,626 | S | | 1/2002 | Petri | |
| D452,787 | S | | 1/2002 | Petri | |
| 6,401,630 | B1 | | 6/2002 | Peterson | |
| D468,135 | S | | 1/2003 | Ashby et al. | |
| D469,994 | S | * | 2/2003 | Smith | D6/499 |
| D469,996 | S | | 2/2003 | Ashby | |
| D470,352 | S | | 2/2003 | Strong | |
| 6,530,331 | B2 | | 3/2003 | Stanford | |
| 6,550,404 | B2 | | 4/2003 | Stanford | |
| D481,567 | S | | 11/2003 | Ashby et al. | |
| 6,912,961 | B2 | * | 7/2005 | Winter et al. | 108/118 |
| 7,036,437 | B2 | | 5/2006 | Choi et al. | |
| 7,059,254 | B2 | | 6/2006 | Strong et al. | |
| 2002/0152934 | A1 | | 10/2002 | Haney | |
| 2005/0126451 | A1 | | 6/2005 | Winter et al. | |
| 2006/0191447 | A1 | | 8/2006 | Ashby et al. | |

OTHER PUBLICATIONS

Declaration of Maxine Lesht in Support of GSC's Response to Lifetime's Motion for Temporary Restraining Order and Preliminary Injunction of the GSC "Enduro2" Personal Table, 18 pages (including Exhibits 1-2), Oct. 5, 2003. *Lifetime Products* v. *GSC Technology Corporation*, Case No. 1:03CV00062TC (N.D. Utah).

Blow Mold Products/Outdoor Products, Dongguan Shichang Metals Factory Co., Ltd., 4 pages, Date Unkown (copyright notice includes the years 2002-2003).

Mosaic, profile edge in center, Gunlock Co. © 2003, p. 3.

* cited by examiner

*Primary Examiner*—José V Chen
(74) *Attorney, Agent, or Firm*—Workman Nydegger

(57) ABSTRACT

A personal table is provided having a table top supported by a support assembly. The table top is preferably constructed from blow-molded plastic and the support assembly preferably includes a first leg and a second leg that are pivotally connected. The legs desirably have a generally X-shaped configuration when the legs are placed in an upright position and the legs can be collapsed into a storage position. Each of the legs may include a lower portion, a body portion and an upper portion that is preferably selectively connected to the table top. The legs, for example, can be connected to the table top by inserting the upper portions of the legs into leg receiving recesses formed in the table top. The leg receiving recesses are preferably integrally formed in the bottom surface of the table top as part of a one-piece construction. Desirably, a plurality of leg receiving recesses are formed in the bottom surface of the table top and the legs can be selectively attached to the leg receiving recesses in order to vary the height of the table.

16 Claims, 7 Drawing Sheets

PERSONAL TABLE

CROSS-REFERENCE TO RELATED APPLICATIONS

This application claims priority to and the benefit of U.S. provisional patent application Ser. No. 60/660,526, filed Mar. 10, 2005 and entitled PERSONAL TABLE.

This application is also a continuation-in-part of U.S. patent application Ser. No. 11/038,375, filed Jan. 18, 2005, entitled PERSONAL TABLE, now U.S. Pat. No. 7,263,932; which is a continuation of U.S. patent application Ser. No. 10/340,018, filed Jan. 9, 2003, entitled PERSONAL TABLE, now U.S. Pat. No. 6,912,961; which claims priority to and the benefit of U.S. provisional patent application Ser. No. 60/347,556, filed Jan. 9, 2002, entitled PERSONAL TABLE; U.S. provisional patent application Ser. No. 60/364,712, filed Mar. 14, 2002, entitled PERSONAL TABLE; and U.S. provisional patent application Ser. No. 60/421,221, filed Oct. 25, 2002, entitled PERSONAL TABLE. In addition, U.S. patent application Ser. No. 10/340,018 is a continuation-in-part of U.S. design patent application Ser. No. 29/167,624, filed Sep. 18, 2002, entitled TABLE LEG, now U.S. Pat. No. D469,994; is a continuation-in-part of U.S. design patent application Ser. No. 29/167,628, filed Sep. 18, 2002, entitled TABLE TOP, now U.S. Pat. No. D469,996; and is a continuation-in-part of U.S. design patent application Ser. No. 29/167,611, filed Sep. 18, 2002, entitled TABLE TOP, now U.S. Pat. No. D470,352.

This application is also a continuation-in-part of U.S. patent application Ser. No. 10/692,892, filed Oct. 24, 2003 and entitled PERSONAL TABLE, now U.S Pat. No. 7,059,256; which claims priority to and the benefit of U.S. provisional patent application Ser. No. 60/421,221, filed Oct. 25, 2002, entitled TABLE. In addition, U.S. patent application Ser. No. 10/692,892 is a continuation-in-part of U.S. patent application Ser. No. 10/340,018, filed Jan. 9, 2003, entitled PERSONAL TABLE, now U.S. Pat. No. 6,912,961; a continuation-in-part of U.S. design patent application Ser. No. 29/176,792, filed Feb. 26, 2003, entitled PORTION OF A TABLE TOP, now U.S. Pat. No. D485,100; a continuation-in-part of U.S. design patent application Ser. No. 29/176,842, filed Feb. 26, 2003, entitled TABLE TOP, now U.S. Pat. No. D485,719; and a continuation-in-part of U.S. design patent application Ser. No. 29/176,841, filed Feb. 26, 2003, entitled SUPPORT FOR A TABLE TOP, now U.S. Pat. No. D481,567.

Each of these patents and applications are expressly incorporated by reference in their entireties.

BACKGROUND

1. Field of the Invention

The present invention generally relates to tables and, in particular, to a light-weight table that may be adjustable in height and may have legs that can be moved between an extended or use position and a collapsed or storage position.

2. Background Art

Conventional tables are used for a variety of purposes and come in a wide array of designs. In some situations, it is desirable to have a smaller table for personal or individual use. For example, persons living in a small space, such as a studio apartment, may choose to use a smaller personal-sized table on which to dine or perform other tasks. Other persons may use a personal table to place beside a chair for the convenience of holding objects while reading, watching television or listening to the radio. Still others may use personal tables to perform tasks such as writing, working, or using a computer.

Conventional tables often include table tops constructed from wood, particle board or metal. Table tops constructed from wood, particle board or metal, however, are often relatively heavy and this may make the table awkward or difficult to move. Conventional table tops constructed from wood or metal are also relatively expensive and the table tops must generally be treated or finished before use. For example, table tops constructed from wood must generally be sanded and painted, and metal table tops must be formed into the desired shape and painted. In addition, these relatively heavy table tops increase the cost of transportation, shipping, and storage of the tables.

In order to decrease the weight of conventional tables, table tops can be constructed from relatively thin, light-weight materials. Disadvantageously, these light-weight table tops frequently require reinforcing members or other structural parts such as brackets, support members and the like to strengthen the table top. These additional parts may increase the strength of the table top, but these additional parts also increase the weight of the table. In addition, these additional parts increase manufacturing costs and require additional time to assemble the table. Furthermore, these additional parts may have sharp edges that can injure the user's arms or legs.

Known tables may also allow the height of the table to be adjusted to suit the needs of a particular user. For example, the length of the table legs may be increased or decreased by a telescoping assembly. Disadvantageously, because the telescoping assemblies include overlapping components, the assembly is relatively heavy. Additionally, conventional tables may use other mechanisms to allow the height of the table to be adjusted, but these devices are often relatively complex and require additional parts, which generally increases the amount of time required to manufacture the table and the costs to assemble the table. These complex designs may also result in tables that are relatively difficult for the consumer to use and these tables may require a substantial amount of time in order for the height of the table to be adjusted.

Another type of known table is a traditional card table in which each leg is pivotally connected to the table top by a brace and each leg individually folds against the table top. It is known to attempt to reduce the inconvenience of individually folding each of the legs against the table top by coupling two of the legs together by a long connecting rod. This may increase the stability of the table top and enable the user to simultaneously fold two legs into the collapsed position. The long connecting rods, however, may increase the cost of the table, reduce space under the table top, and the rods often easily break or become disconnected.

Conventional tables may also detachably connect the legs to the table top to allow the user to more easily collapse, move and store the table. Disadvantageously, the detachable legs often create a table that is not sturdy or stable. Additionally, moving a table with this type of attachment when the legs are still attached is often difficult because the legs may undesirably detach. These known types of table may include an attachment that mechanically secures the leg to the table top. These mechanical attachments, such as plastic or metal clips or brackets, often break or are otherwise damaged. Further, attachment of these devices to the table top may structurally weaken the table top, which may allow the table to unexpectedly fail. Further, attaching multiple separate attachment mechanisms to the table top by fasteners, such as screws or bolts, may undesirably weaken the table top.

Many conventional tables include four separate legs in order to support the table top above a surface such as the floor. The four separate legs, however, often undesirably increase the weight of the table. In additional, the four legs typically require four different attachment mechanisms to attach the legs to the table top, which may increase the cost and complexity of the table. The four separate attachment mechanisms may also undesirably increase the weight of the table and require multiple mechanical fasteners, such as screws and bolts, to connect the attachment mechanisms to the table top. As discussed above, these attachment mechanisms and mechanical fasteners may undesirably weaken the table top.

SUMMARY

A need exists for a table that eliminates the above-described disadvantages and problems.

One aspect is a table that preferably has a relatively small size, which may make the table easily portable and storable. In particular, the table is preferably sized and configured to be used by a single person. This type of table that is intended for use by an individual is referred to as a personal table, but it will be appreciated that more than one person could use the table if desired. Advantageously, the personal table may relatively small and light-weight, which makes the table easy to move and transport. Significantly, because the table is sized and configured for personal use, it does not take up unnecessary space or provide a large amount of unused space. Therefore, the personal table provides ample space for a single user without requiring a large area or wasting unnecessary space.

Another aspect is a table that may be used for a wide variety of different situations and uses such as a table for supporting a television, computer, sewing machine, microwave, lamp, luggage, and the like. The table may also be used for a wide variety of other uses such as a bedside table, coffee table, night stand, desk, shop table, and the like. Further, the table may be used while performing a wide variety of tasks such as reading, writing, studying, working, etc. Thus, the personal table may be used in a number of different environments and it can be used to perform numerous different tasks.

Still another aspect is a table that may be suitable for use in a variety of situations and environments because it preferably provides ample space for a user, while at the same time being lightweight so as to enable the table to be moved from place to place with relative ease. Advantageously, the table can have different sizes and configurations depending upon the desired use of the table. The table may also have a larger size so that it can be used by more than one person at a time.

A further aspect is a table that may include a table top that is preferably constructed from a lightweight material so that the table is easily portable and can be readily lifted and moved by a single person. Desirably, the table top is constructed from blow-molded plastic, such as high density polyethylene. The blow-molded table top provides a rigid, high-strength structure that is capable of withstanding repeated use and wear. Advantageously, the blow-molded table top can be easily manufactured and formed into the desired size and shape.

Yet another aspect is a table that may have a height that can be readily adjusted. Advantageously, the adjustable height table allows it to be used for many different purposes. For example, the height of the table may be adjusted to allow the table to be used as a desk, televisions stand, bedside table or end table.

A still further aspect is a table that may include a table top that is support by a single pair of legs. The legs are preferably pivotally connected and the legs preferably allow the height of the table top to be easily adjusted. Significantly, because the table top is support by a single pair of legs, that may provide additional leg room and/or storage room under the table. In addition, the single pair of legs may be light-weight and easily attached to the table top. The single pair of legs are desirably sized and configured to support the table top and any suitable objects placed on the table. Advantageously, because the personal table has a relatively small size, the single pair of legs can properly support the table top.

Another aspect is a table that may include a table top that is supported by a single pair of legs and the legs are preferably pivotally connected by a pin, bolt or screw into a generally X-shaped configuration. The pivotal connection may advantageously allow the legs to be quickly moved between the storage and use positions. The pivotal connection may also allow the height of the table to be readily adjusted. Desirably, each leg includes a lower portion that contacts a support surface such as the floor, an elongated body portion, and an upper portion that is sized and configured to be connected to the table top. The elongated body portion of each of the legs may include two or more support members, which may help prevent twisting of the legs and/or undesirable torque on the connection of the upper and lower portions to the elongated body portion.

Yet another aspect is a table that may include legs which are attached to the underside of the table top and the legs are preferably offset from the center of the table. In particular, the legs are preferably positioned near an outer edge of the table top to provide enhanced legroom for the user. This may allow the table top to be positioned closer to the body of the user when the table, for example, is being used as a desk or for a writing surface. Advantageously, this may make the table more convenient for the user. In addition, the lower portion of the legs may form elongated feet that are used to create a stable base for the table top.

A still further aspect is a table that may include legs which are movable between a use position and a storage position. The legs preferably extend outwardly from the table top in the use position and the legs support the table top above a surface such as the floor. In the storage position, the legs are preferably collapsed into a relatively compact area, which allows the table to be easily transported or stored. The legs, for example, may be placed adjacent and/or proximate to the bottom surface of the table top in the collapsed position. Advantageously, the collapsed legs may facilitate stacking of the tables and decrease the space required to store or ship the tables.

Another aspect is a table that may include a table top with one or more openings that are sized and configured to receive the legs in the storage position. For example, the table top may include a lip with openings that are sized and configured to receive the legs in the storage position. In particular, the lip may include openings disposed on one side of the table top and openings disposed on another side of the table top. The openings are preferably sized and configured to allow the legs to be folded into the storage position. Advantageously, the storage position may facilitate stacking of the tables and decrease the space required to store or ship the tables. Further, the openings may be sized and configured to retain the legs in the collapsed position, which may help prevent the legs from being inadvertently moved from the collapsed position. It will be appreciated that the openings do not have to retain the legs in the collapsed position and the openings may be formed in any suitable portion of the table top.

Yet another aspect is a table that may include a support assembly that is sized and configured to support a table top above a support surface. Preferably only a single support assembly is used to support the table top. The support assembly may include, for example, two legs that are pivotally connected. The legs may include one or more elongated body portions and the body portions may have an offset configuration. For example, a portion of one leg may be offset with respect to another portion of the leg. In addition, the body portion of one leg may be offset with respect to another leg. Advantageously, the support assembly may permit the table to be collapsed into a more compact configuration and thus decrease the space required to store or ship the tables and facilitate stacking.

A further aspect is a table that may be adjustable in height according to the needs of the user. For example, the bottom surface of the table top may include a plurality of leg receiving recesses or portions that are sized and configured to selectively receive a portion of at least one of the legs. Desirably, one or more of the legs can be readily moved from one leg receiving recess to another leg receiving recess to allow the height of the table to be adjusted. For example, at least one of leg receiving recesses may be disposed towards an edge of the table top and at least one of the leg receiving recesses may be disposed towards the center portion of the table top. One or more of the legs may be selectively inserted and removed from the leg receiving recesses to allow the height of the table to be adjusted. Advantageously, by connecting the legs to different leg receiving recesses, the height of the table top can be readily adjusted. Significantly, the readily adjustable legs may provide increase flexibly and a variety of uses for the personal table. For instance, the adjustable height table may be positioned at a desired height for eating, watching television, or supporting items next to a chair. The adjustable height legs may also be quickly and easily folded into a storage position.

A still further aspect is a table that may include a support assembly or legs that are selectively attached to the table top. For example, the table may include two legs and one or both of the legs may be selectively detached from the table top to allow the legs to be moved from an extended to a collapsed position. In addition, the selective detachment of one or both of the legs may allow the height of the table to be easily adjusted by attaching the legs to different leg receiving recesses. One of the legs may also be permanently attached to the table top and the other leg may be selectively attached to the table top. Thus, in order to adjust the height of the table, the one leg may be selectively connected to the table top. In addition, in order to move the legs into the collapsed position, the leg may be detached from the table top.

Yet another aspect is a table that may include a variety of suitable sizes and configurations. In addition, the table may be adjustable in height and the legs may be movable between an extended position and a storage position. Thus, the table can be optimized for a specific use, or the table can be easily adjustable for a variety of different uses.

Advantageously, the table may be relatively simple to manufacture because it preferably consists of a table top constructed from blow-molded plastic and a pair of pivotally interconnected legs. The blow-molded table top may include two opposing walls that are spaced apart a predetermined distance, which may help increase the strength and rigidity of the table top. Desirably, the opposing surfaces are separated by a generally constant distance, but the surfaces can be separated by any suitable distance or distances. The blow-molded table top may also include one or more depressions or tack-offs to further increase the strength of the table top and/or interconnect the spaced apart walls. Significantly, the blow-molded table top may be light-weight, durable, generally weather resistant and temperature insensitive, and it does not corrode, rust or otherwise deteriorate. The blow-molded table top can also be formed in various shapes, sizes, configurations and designs.

Additionally, the table may be easy to assemble, which may reduce manufacturing and labor costs. Further, the consumer can easily assemble the personal table and the consumer will appreciate many of the aspects of the personal table such as the light-weight, easy height adjustment, portability, sturdiness, and wide variety of uses in any different environments.

Another aspect is a table that may include a frame that is attached to the table top. The frame may include two side rails that are attached to opposing sides of the table top. The side rails may be attached a lip of the table top and one or more mechanical fasteners may be used to attach the side rails to the lip. The frame, however, could have other suitable arrangements and configurations, and the table does not require the use of a frame.

Still another aspect is a table that may include a frame and the frame may be sized and configured to secure one of the table legs or a portion of the support structure in a fixed position. For example, the frame may include two side rails and a portion of one of the table legs or support structure may be secured in a fixed position by the side rails. In particular, an upper portion of a table leg or support structure may be disposed between the side rails and a lower portion of the table top. Additionally, a channel or groove may be formed in the lower portion of the table top to receive at least a portion of the upper portion of the table leg or support structure. Advantageously, this may allow the leg or portion of the support structure to be quickly and easily secured in a fixed position, and this may also allow the legs to be positioned near or adjacent to the lower portion of the table top when the legs are in the collapsed position. Significantly, this may allow the legs to fold flat against the lower portion of the table top, which may facilitate shipping and storage of the table.

Yet another aspect is a table that may be adjustable in height by selectively connecting the table legs or support assembly to various receiving portions. The receiving portions, for example, may include a channel or groove formed in the lower portion of the table top. The receiving portions may also include retaining portions disposed at opposing ends of the channels or grooves. In particular, the receiving portions may extend across a portion of the lower portion of the table top and the retaining portions may include openings that are sized and configured to receiving the ends of a table leg or support assembly. The openings may be at least partially defined by a portion of a frame, such as the side rails. Specifically, a channel or groove may be disposed on one side of the retaining portion and the side rail may be disposed on the other side to define at least a portion the opening. Advantageously, this may allow the table leg or support assembly to be quickly and easily connected to the table top. In addition, this may also allow the legs to fold flat against the lower portion of the table top, which may facilitate shipping and storage of the table. Further, this may allow the legs to be securely connected to the table top, which may help create a strong and sturdy table.

A further aspect is a table that may include receiving portions that are sized and configured to receive a portion of the legs when the legs are in the collapsed position. The receiving portions may be formed in the lip and receiving portions are preferably formed on opposing sides to allow one leg to be received within a receiving portion disposed on one side of the table top and the other leg to be received within a receiving portion disposed on the other side of the table top. The receiving portions may be sized and configured to receive and retain the legs in the collapsed position. For example, the legs may be retained in the collapsed position by a snap, friction or interference fit. This may reduce or eliminate the need for other structures, such as clips, to retain the legs in the collapsed position.

A still further aspect is a table that may include one or more legs or a support assembly that supports the table top above a surface such as the ground. For example, the legs preferably have a generally X-shaped configuration in the extended position and the legs may include an elongated body and an upper portion that is sized and configured to be attached to the table top. Desirably, the upper portion of the legs is connected to a side of the elongated body instead of the distal end. In particular, the upper portion is preferably connected to the side of the elongated body proximate the end of the elongated body and the upper portion is not aligned with an axis extending through the elongated body. Advantageously, this may allow at least a portion of the upper portion of the leg to be disposed in a groove or channel formed in the lower portion of the table top, such as a groove or channel of a receiving portion. This may allow the elongated body portion of the legs to fold flat against the lower portion of the table top, which may facilitate shipping and storage of the table.

Another aspect is a table that may include a support assembly with legs that fold flat against the lower portion of the table top when the legs are in the collapsed position. Advantageously, if the legs fold flat against the lower portion of the table top and the legs do not extend beyond a plane generally aligned with a lower portion of the table top, then the height of the table in the storage position may be generally equal to the thickness of the table top. This may reduce shipping and storage costs because more tables may be placed within the same size packaging and/or shipping container.

These and other aspects, features, and advantages of the present invention will become more apparent from the following detailed description of preferred embodiments and appended claims.

BRIEF DESCRIPTION OF THE DRAWINGS

The appended drawings contain figures of preferred embodiments of the personal table. The above-mentioned aspects, features and advantages of the personal table, as well as other aspects, features and advantages, will be described in connection with the preferred embodiments. It is appreciated that these drawings depict only certain preferred embodiments of the invention and are therefore not to be considered limiting of its scope. The invention will be described and explained with additional specificity and detail through the use of the accompanying drawings in which.

DETAILED DESCRIPTION OF PREFERRED EMBODIMENTS

The present invention is directed towards a table and, in particular, to a table that is intended to be used by a single user at one time. The principles of the present invention, however, are not limited to a table intended for use by an individual user. It will be understood that, in light of the present disclosure, the table can be used by more than one user at any given time.

Additionally, to assist in the description of the table, words such as top, bottom, front, rear, right and left are used to describe the accompanying figures. It will be appreciated, however, that the table can be located in a variety of desired positions—including various angles, sideways and even upside down. A detailed description of the table now follows.

Figure 1:
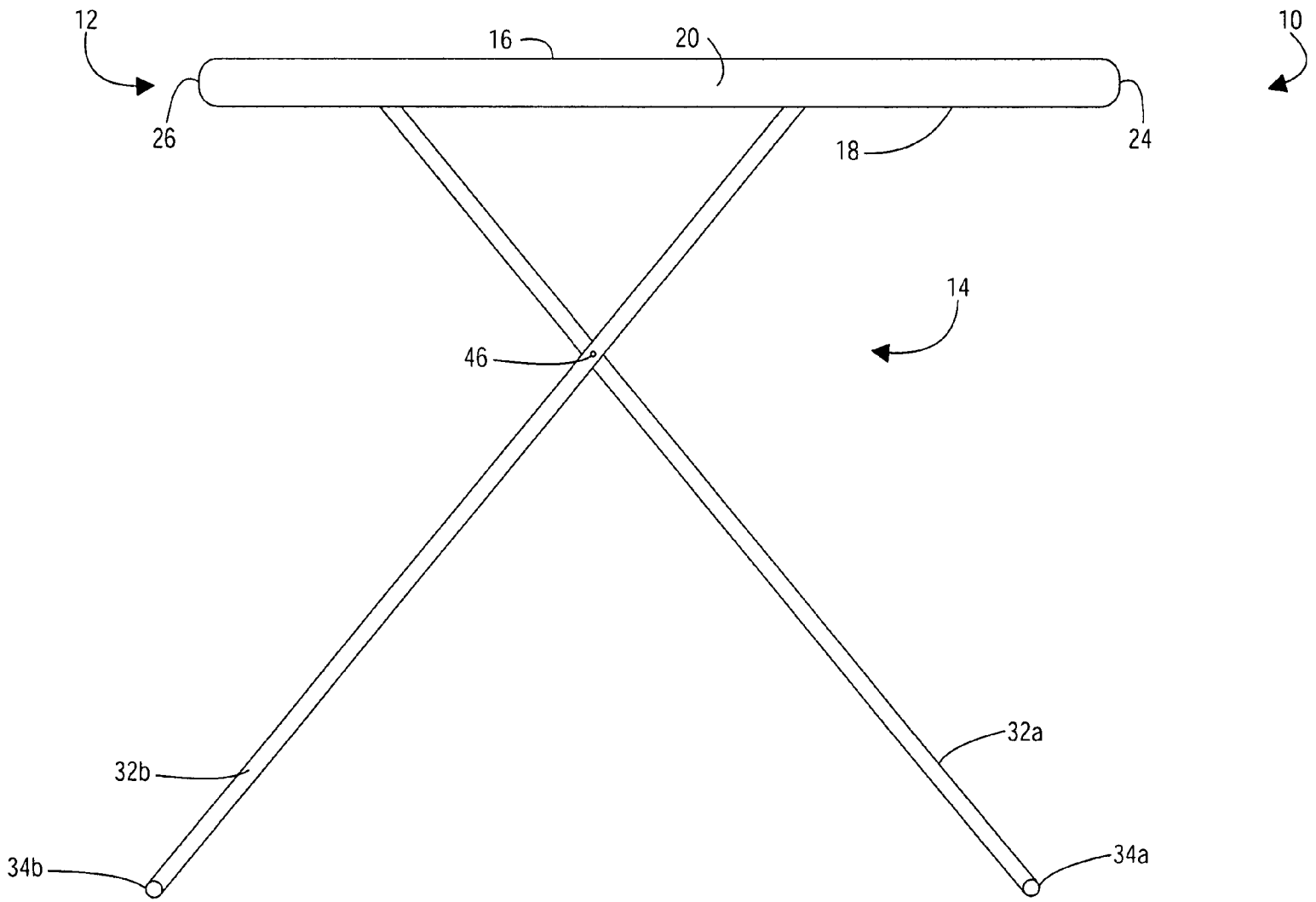
FIG. 1 is a front view of an exemplary embodiment of a personal table, illustrating the legs in an extended position.
Figure 2:
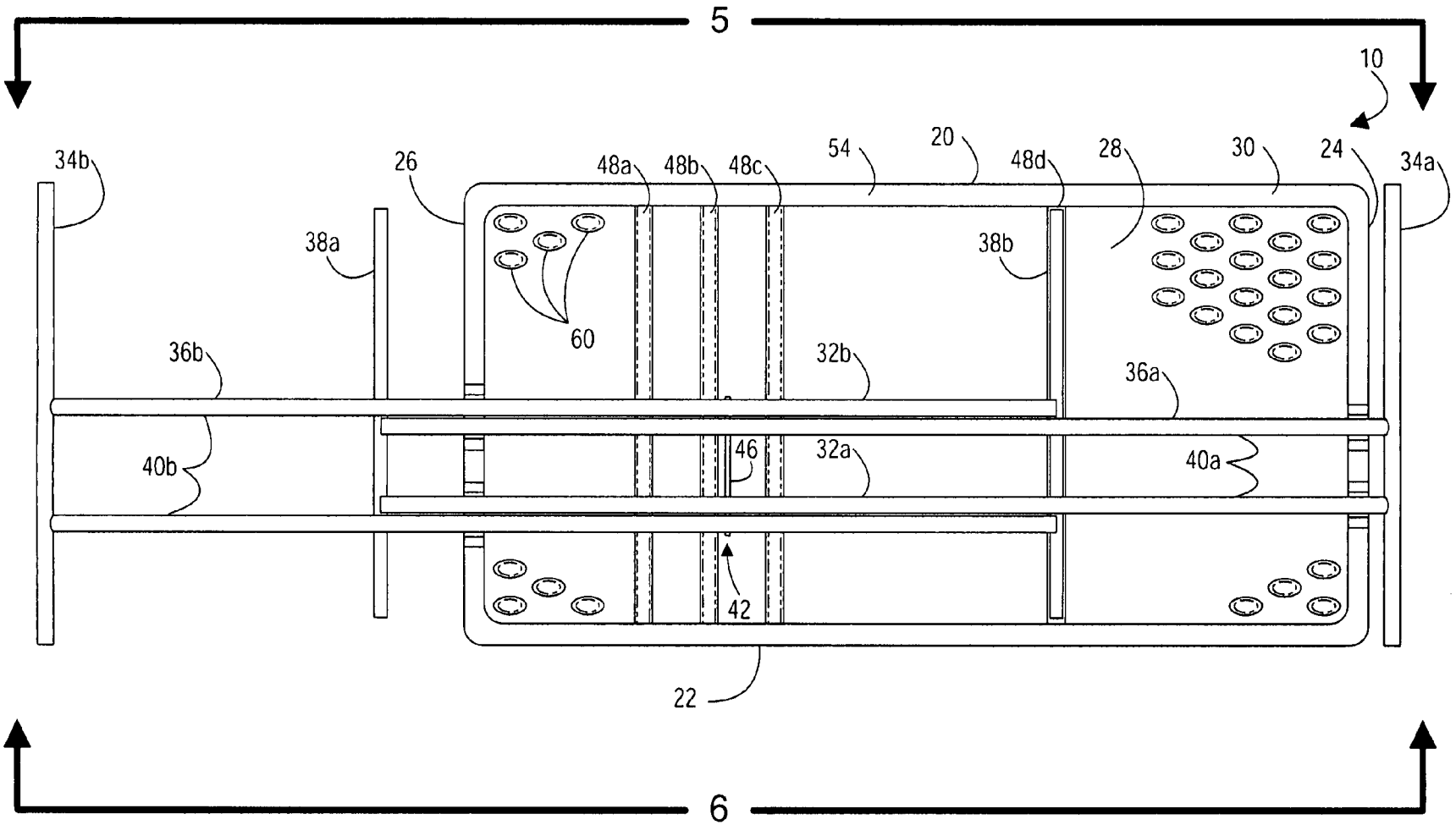
FIG. 2 is a bottom view of the personal table shown in FIG. 1, illustrating the legs in a collapsed position.

As seen in FIGS. 1 and 2, an exemplary table 10 is shown. The table 10 is preferably a relatively small-sized table that is intended for use by a single person at one time. Advantageously, because the table 10 is sized and configured for personal use, it does not require a large amount of space. Therefore, the table 10 provides ample space for a single user without requiring a large area or unnecessary space. This table 10 that is sized and configured for use by a single person is referred to as a personal table.

The personal table 10 includes a table top 12 and a support assembly 14 that is used to support the table top above a surface such as the floor or ground. The table top 12 includes a top 16, bottom 18, front 20, rear 22, right side 24 and left side 26. The table top 12 may also include a beveled, sloped or rounded surface disposed between the top surface 16 and one or more of the sides 20, 22, 24 and 26. The beveled surface may be sized and configured to increase the comfort and safety of the user. The beveled surface, for example, may be larger along the front 20 of the table top 12, but it will be appreciated that the table 10 does not require a beveled surface.

As shown in FIGS. 1 and 2, the table top 12 preferably has a generally rectangular configuration with rounded corners. The table top 12 may include slightly rounded outer edges or sides 20, 22, 24, and 26. Desirably, the table top 12 is about thirty (30) inches in length and about twenty (20) inches in width, but one skilled in the art will appreciate that the table top can have other suitable sizes and configurations. For example, the table top 12 may be larger or smaller and the table top can have other configurations such as square, circular, oval, and the like depending, for example, upon the intended use of the table 10. In addition, the corners and edges of the table top 12 do not have to rounded and, in contrast, the corners and edges could have any desirable configuration, but the rounded features may increase the comfort and/or safety of the user.

Advantageously, the table 10 can be used for a wide variety of purposes and in a number of different environments. For instance, the table 10 can be used as a television stand, computer table, sewing table, bedside table, coffee table, microwave stand, desk, shop table, luggage stand and the like. In addition, the table 10 can be used for working, reading, writing and other suitable uses. Accordingly, the table 10 is capable of many different uses and it is preferably sized and configured to be used by a single person at one time. The table 10, as discussed in more detail below, is preferably sized and configured to support one or more objects related to these different tasks and uses. For example, the table 10 is desirably configured to support a television, computer, books, or luggage according to its intended use by the individual user.

The table top 12 is preferably constructed from a lightweight material and, more preferably, the table top is constructed from plastic, such as high density polyethylene. The plastic table top 12 is desirably formed by a blow-molding process because, for example, it allows a strong, lightweight, rigid and sturdy table top to be quickly and easily manufactured. Advantageously, the blow-molded plastic table top 12 has a lighter weight that conventional table tops constructed from wood or metal because, for example, the blow-molded plastic table top may include a generally hollow interior portion, which may be integrally formed in the table top during the blow-molding process. The blow-molded plastic table top can be constructed from less plastic than conventional plastic table tops, which may save manufacturing costs and reduce consumer costs. In particular, the blow-molded table top 12 can be manufactured with thin plastic walls and that allows the table top to cool faster during the manufacturing process, which decreases the manufacturing time. Further, the blow-molded plastic table top 12 can be constructed with any suitable shape, configuration, size, design and/or color depending, for example, upon the intended use of the table 10. For example, the table top 12 can be constructed with a generally rectangular configuration of about eighteen by about twenty-four inches (18×24), a table top with a generally circular configuration with a diameter of about twenty inches (20) or a table top with a generally square configuration with twenty-four inch (24) sides may be easily formed during the blow-molding process. Of course, it will be appreciated that the blow-molded table top 12 can have any suitable size and configuration depending, for example, upon the intended use of the personal table 10.

The table top 12 is preferably constructed from blow-molded plastic because blow-molded plastic table tops are durable, weather resistant, generally temperature insensitive, corrosion resistant, rust resistant, and generally do not deteriorate over time. One skilled in the art, however, will appreciate that the table top 12 does not have to be constructed from blow-molded plastic and other suitable materials and/or processes can be used to construct the table top depending, for example, upon the intended use of the personal table 10. Thus, the table top 12 could be constructed from other materials with suitable characteristics, such as wood, metal, and other types of plastic. Additionally, the table top 12 does not have to be constructed from blow-molded plastic and it could be constructed from injection molded plastic, extrusion molded plastic, and the like.

As shown in FIG. 1, the top 16 and bottom 18 surfaces of the table top 12 are spaced apart a given distance and these two spaced apart surfaces help create a rigid and strong table top 12. Additionally, the top and bottom surfaces 16, 18 may be interconnected by one or more depressions or other reinforcement structures and these structures may be sized and configured to increase the strength and/or rigidity of the table top 12. Advantageously, these depressions and/or other reinforcement structures can be integrally formed in the table top 12 as part of a one-piece structure, for example, during the blow-molding process.

Figure 3:
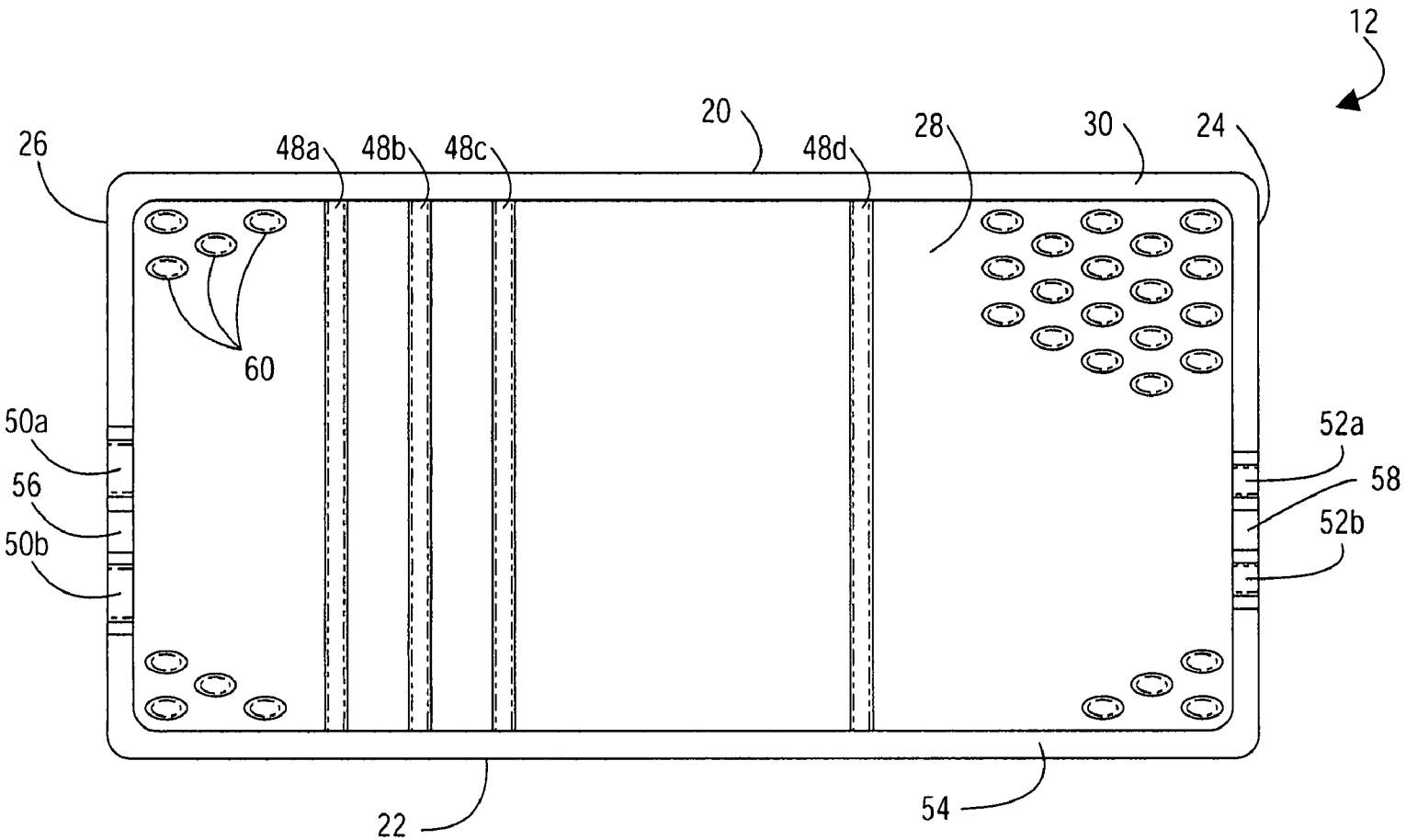
FIG. 3 is a bottom view of a portion of the personal table shown in FIG. 1.

As best shown in FIGS. 2 and 3, the table top 12 may include a recessed a center section 28, which may cover substantially all or just a portion of the bottom 18 of the table top 12. The table top 12 may also include a lip 30 that extends downwardly from the lower portion of the table top and/or the lip may form part of an outer edge or perimeter of the table top. In greater detail, the lip 30 may be disposed about the outer edges of the table top 12 and the lip may be integrally formed with the table top 12 as part of a one-piece structure. For example, the lip 30 could include a hollow interior portion that is formed during the manufacturing process and the hollow interior portion may be in direct communication with a hollow interior portion of the table top 12. The lip 30, however, could also be a separate structure that is attached to the table top 12 and the lip could be disposed inwardly from the outer edges or perimeter of the table top. It will be appreciated that the lip 30 could have other suitable arrangements and configurations, and the table 10 does not require the lip.

As discussed above, the support assembly 14 is used to support the table top 12 above a surface such as the ground or floor. As best shown in FIGS. 1, 2, 4, 7, and 8, an exemplary embodiment of the support assembly 14 includes a first leg 32*a* and a second leg 32*b*. The first leg 32*a* and the second leg 32*b* preferably each include a lower portion 34*a*, 34*b*, a body portion 36*a*, 36*b*, and an upper portion 38*a*, 38*b*, respectively. The lower portion 34*a*, 34*b* of each of the legs 32*a*, 32*b* is preferably sized and configured to contact the ground or floor. Desirably, the lower portion 34*a*, 34*b* is an elongated member that has a length slightly less than the width of the table top 12 to provide a relatively stable base, but the elongated member could be longer or shorter. The lower portions 34*a*, 34*b* are preferably generally hollow tubes that are lightweight and easy to manufacture, and the tubes are preferably constructed from metal; but any suitable materials may be used to construct the lower portions of the legs, and the lower portions of the legs could have other suitable configurations. End caps (not shown) may be attached to the ends of the lower portions 34*a*, 34*b* to prevent foreign objects from entering the generally hollow tubes and the end caps may provide a non-skid and non-marking surface. The end caps may also be sized and configured to assist in moving the table 10, if desired. It will be understood, however, that neither the lower portions 34*a*, 34*b* nor end caps are required.

As shown in the accompanying figures, the lower portions 34*a*, 34*b* of the legs 32*a*, 32*b* are preferably positioned generally parallel to each other to provide a stable base for the personal table 10 that resists tipping. It will be appreciated, however, that the lower portions 34*a*, 34*b* could have any desirable size, configuration or design depending, for example, upon the intended use of the personal table 10. For example, the lower portions 34*a*, 34*b* could have a triangular, square, rectangle, generally planar or other suitable shape and configuration, and the lower portions 34*a*, 34*b* could have any suitable width and length depending, for example, upon the intended use of the table 10.

The body portions 36*a*, 36*b* of the legs 32*a*, 32*b* preferably comprise one, two, or more elongated members that are used to support the table top 12 above a surface such as the ground or floor. It will be appreciated that the lengths of the body portions 36*a*, 36*b* of the legs 32*a*, 32*b* are preferably the same so that the table top 12 is supported in a generally horizontal position relative to the support surface. It will also be appreciated that the length of the body portions may help determine the overall height of the table 10. The body portions 36*a*, 36*b* of each leg 32*a*, 32*b* are preferably constructed from one, two, or more generally hollow members, such as hollow metal tubes, which are lightweight and easy to manufacture. But, of course, the body portions may have any desired sizes and/or configurations, which could be the same, similar, or entirely different.

The ends of the body portions 36*a*, 36*b* are preferably securely connected to the lower portions 34*a*, 34*b* of the legs 32*a*, 32*b* by welding or other suitable means. Similarly, the opposing ends of the body portions 36*a*, 36*b* are preferably securely connected to the upper portions 38*a*, 38*b* of the legs 32*a*, 32*b* by welding or other suitable means. Also, some or all of the portions of a leg (such as, lower portions, body portions, and upper portions) may be constructed as part of a unitary, one-piece leg or could be constructed as a plurality of interconnected portions.

Figure 4:
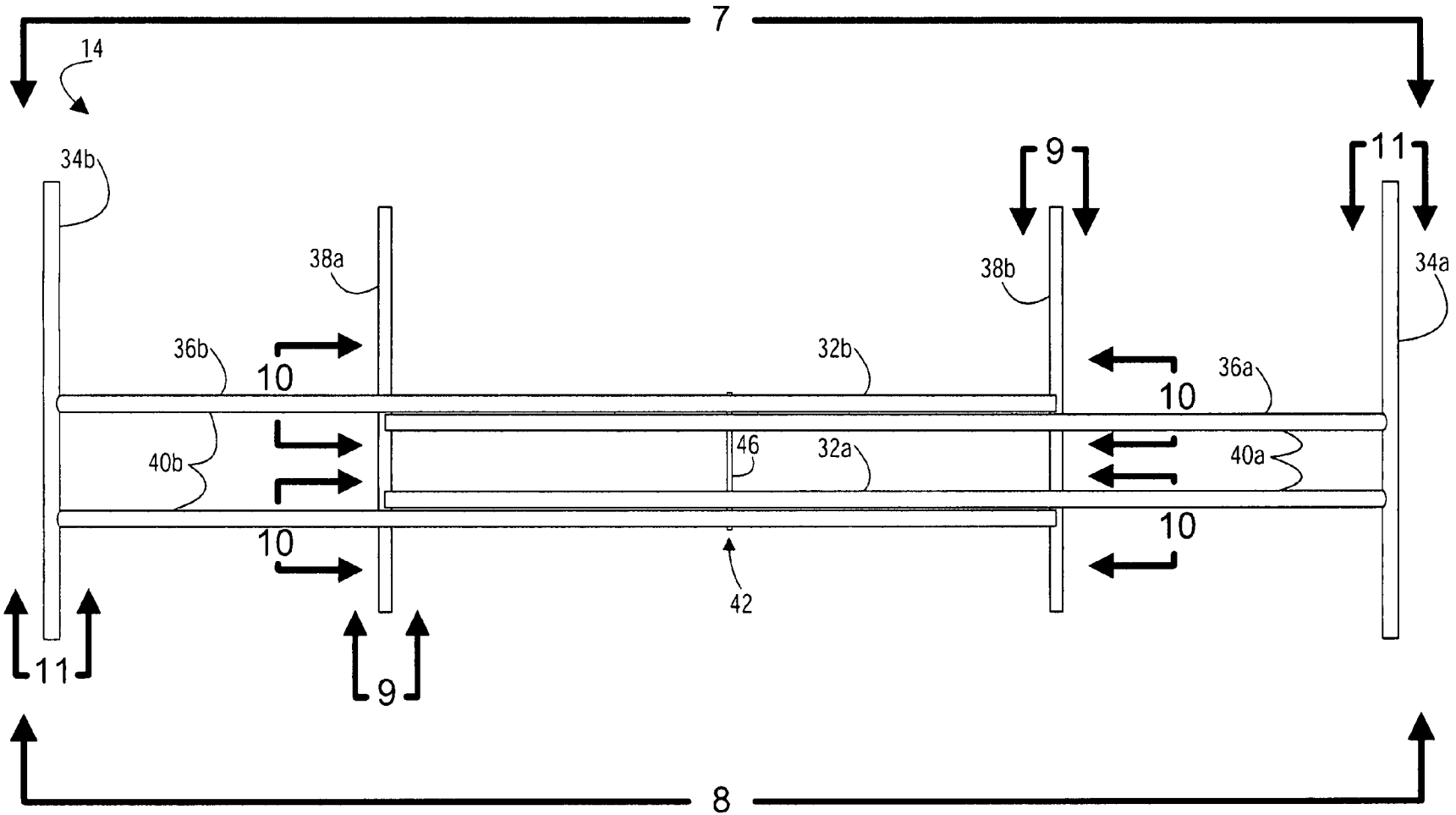
FIG. 4 is a bottom view of a portion of the personal table shown in FIG. 1, illustrating the support assembly.

As best shown in FIGS. 2, 4, 7 and 8, the body portions 36*a*, 36*b* of the legs 32*a*, 32*b* may include two separate elongated support members 40*a*, 40*b*. Advantageously, body portions 36*a*, 36*b* constructed with two separate elongated support members 40*a*, 40*b* may help prevent twisting or torque on the connection of the body portions to the lower portions 34*a*, 34*b* of the legs 32*a*, 32*b*. Additionally, the two separate elongated support members 40*a*, 40*b* of the body portions 36*a*, 36*b* may be spaced apart and may be generally straight. In particular, the upper and lower portions of the body portions 36*a*, 36*b* may be spaced apart to facilitate connection of the body portions to the lower portion 34*a*, 34*b*, to the upper portion 38*a*, 38*b*, or to both—which may create a more secure, stable connection. As best shown in FIG. 4, the support members 40*a* may be spaced apart and may also be generally parallel, and the support members 40*b* may be spaced apart and may also be generally parallel. Also, some or all of the support members 40*a* may be generally parallel to some or all of the support members 40*b*. In another embodiment, the upper and lower portions of the body portions 36*a*, 36*b* may be curved outwardly and away from each other, and the middle portions of the body portions 36*a*, 36*b* may be curved or arched towards each other to allow the body portions to be connected. Of course, body portions 36*a*, 36*b* may include one or more generally straight support members, one or more generally curvilinear support members, and/or any number of other structures having a variety of configurations.

Desirably, the body portions 36*a*, 36*b* are pivotally connected to allow the legs 32*a*, 32*b* to move relative to each other. The legs 32*a*, 32*b* may be connected at a connection point 42 by one or more connectors, such as, a bolt, pin, screw or other type of suitable fastener 46. In one embodiment, the legs 32*a*, 32*b* may be curved together towards the connection point 42 to decrease the length of the fastener 46. In addition, the connection point 42 may be disposed closer to the table top 12 than the lower portions 34*a*, 34*b* of the legs 32*a*, 32*b*, but the legs may be connected at any desired point. It will be appreciated that the legs 32*a*, 32*b* may also be slidably or otherwise movably attached. It will also be appreciated that the body portions 36*a*, 36*b* may include only a single elongated support member 40*a*, 40*b*, or more than two elongated support members if desired.

As best shown in FIGS. 2, 4, 7 and 8, the upper portions 38*a*, 38*b* are attached to the body portions 36*a*, 36*b* of the legs 32*a*, 32*b*. The upper portions 38*a*, 38*b* preferably have generally the same shape and size, and the upper portions are desirably constructed from hollow metal tubes. The hollow tubes preferably have a generally circular configuration, but the tubes may also be oval, oblong, square, rectangular, or may have other suitable configurations. The upper portions 38*a*, 38*b*, however, do not have to be constructed from hollow metal tubes and the upper portions may also be constructed from other suitable components and materials with the appropriate sizes and configurations depending, for example, upon the intended use of the table 10.

As shown in FIGS. 1-3, the upper portions 38*a*, 38*b* of the legs 32*a*, 32*b* are preferably sized and configured to be received with one or more leg receiving channels, grooves, or other recesses. The leg receiving recesses may be formed in a portion of the table top 12, a portion of a table frame, or both. In one embodiment, some or all of the leg receiving recesses preferably may generally the same size and configuration, which may allow the upper portions 38*a*, 38*b* of the legs 32*a*, 32*b* to be interchangeably received by the one or more leg receiving recesses. As best shown in FIGS. 2 and 3, the bottom surface 18 of the table top 12 may include one or more leg receiving recesses (such as, leg receiving recesses 48*a*, 48*b*, 48*c*, and 48*d*), which may be sized and configured to receive all or a portion of an upper portion of a leg (such as, the upper portions 38*a*, 38*b*). Preferably, the upper portions 38*a*, 38*b* are sized and configured to be connected to selected leg receiving recesses using a snap fit, friction fit, an interference fit, or the like, which may allow the legs 32*a*, 32*b* to be quickly and easily attached and detached from the table top 12, but the legs may be connected to the table top in any other suitable manner. One skilled in the art will appreciate that latches, tabs, locking members, clips, fasteners or other suitable devices may optionally be used to retain the upper portions 38*a*, 38*b* of the legs 32*a*, 32*b* in the leg receiving recesses 48*a*, 48*b*, 48*c*, and 48*d*.

The leg receiving recesses 48*a*, 48*b*, 48*c*, and 48*d* preferably generally extend from the front edge to the rear edge of the table top 12, but the leg receiving recesses may be formed in any desired portion of the table top and have any desired size and configuration depending, for example, upon the size and shape of the upper portions 38*a*, 38*b* of the legs 32*a*, 32*b*. The leg receiving recesses 48*a*, 48*b*, 48*c*, and 48*d* may extend from the bottom surface 18 toward the top surface 16. The leg receiving recesses 48*a*, 48*b*, 48*c*, and 48*d* may be spaced apart from the top surface 16, but could contact or engage the top surface. Thus, the leg receiving recesses 48*a*, 48*b*, 48*c*, and 48*d* preferably may extend a portion of the distance from the bottom surface 18 and the top surface 16, but the upper portion of the leg receiving recess may contact or engage the top surface 16 of the table top 12.

Advantageously, the leg receiving recesses 48*a*, 48*b*, 48*c*, and 48*d* formed in the table top 12 may allow the table 10 to be constructed without a frame, which reduces manufacturing costs. However, a table frame could be used, if desired. Additionally, the engagement between leg receiving recesses 48*a*, 48*b*, 48*c*, and 48*d* and the legs 32*a*, 32*b* may create a stable support assembly 14. One skilled in the art will understand that the support assembly 14 can be connected to the table top 12 by other suitable means such as adhesives or mechanical fasteners.

The leg receiving recesses may also include one or more retaining members. The retaining members may flex or bend slightly to allow the upper portions 38*a*, 38*b* of the legs 32*a*, 32*b* to be inserted and removed from the leg receiving recesses. The retaining members preferably resiliently return to their original positions to help secure the upper portions 38*a*, 38*b* of the legs 32*a*, 32*b* within the leg receiving recesses. It will be appreciated, however, that the leg receiving recesses may not require the use of the retaining members to hold the upper portions 38*a*, 38*b* of the legs 32*a*, 32*b* within the leg receiving recesses. In greater detail, the retaining members preferably include a lip, a tab, or the like that extends over a portion of the leg receiving recess, and the lip, tab, or the like may deform or deflect to allow the upper portions 38*a*, 38*b* of the legs 32*a*, 32*b* to be inserted or removed from the leg receiving recess. The lip, tab, or the like may include a generally hollow interior. The lip, tab, or the like may include a generally hollow interior formed during the blow-molding process. In addition, the lip, tab, or the like may be formed during the blow-molding process as part of an integral, one-piece structure.

Advantageously, because the table top 12 preferably includes a plurality of leg receiving recesses 48*a*, 48*b*, 48*c*, and 48*d* and the legs 32*a*, 32*b* can be connected to any suitable leg receiving recesses, which allows the legs to be connected to different leg receiving recesses. As discussed in greater detail below, this may allow the height of the table 10 to be adjusted.

Figure 5:
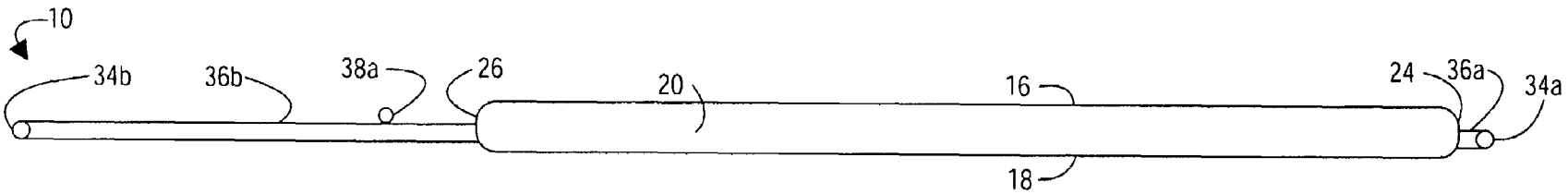
FIG. 5 is a front view of the personal table shown in FIG. 1, illustrating the legs in the collapsed position.
Figure 6:
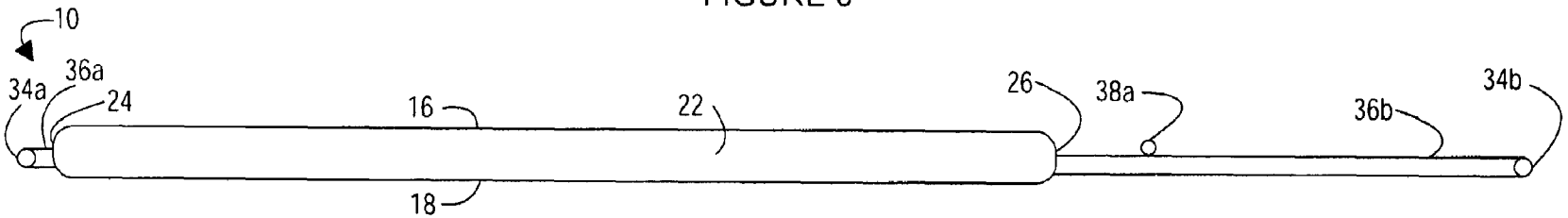
FIG. 6 is a rear view of the personal table shown in FIG. 5.

The legs 32*a*, 32*b* are preferably sized and configured to be quickly and easily connected and/or disconnected to any desired leg receiving recesses 48*a*, 48*b*, 48*c*, and 48*d*. In particular, the legs 32*a*, 32*b* are preferably pivotally connected to allow the legs to pivot or scissor back and forth with respect to one another at a wide variety of angles. This pivotal connection allows the legs 32*a*, 32*b* to be quickly and easily positioned so that the legs can be connected to the desired leg receiving recesses 48*a*, 48*b*, 48*c*, and 48*d* in the table top 12. This pivotal connection also allows the legs 32*a*, 32*b* to be moved between a first or extended position, which is shown in FIG. 1, and a second or collapsed position, which is shown in FIGS. 2, 5, and 6. The legs 32*a*, 32*b* desirably fold generally flat and/or adjacent to each other in the second or collapsed position to allow the personal table 10 to be easily stored or collapsed.

The pivotal connection of the legs 32*a*, 32*b* and the plurality of leg receiving recesses 48*a*, 48*b*, 48*c*, and 48*d* allow the height of the personal table 10 to be easily adjusted. As described in more detail below, the user can select which leg receiving recesses 48*a*, 48*b*, 48*c*, and 48*d* to receive the legs 32*a*, 32*b* and this allows the desired height to be selected. For example, it will be appreciated that if the legs 32*a*, 32*b* are attached to two of the leg receiving recesses 48*a*, 48*b*, 48*c*, and 48*d* that are close together, the table 10 will have a given height. However, if the legs 32*a*, 32*b* are attached to two of the leg receiving recesses 48*a*, 48*b*, 48*c*, and 48*d* that are farther apart, then the table 10 will have a lower height.

The legs 32*a*, 32*b* can desirably be quickly and easily moved between the extended and collapsed positions. For example, if the support legs 32*a*, 32*b* are completely disengaged from table top 12, then the legs 32*a*, 32*b* can be folded into the collapsed position for storage. Alternatively, one or more of the legs 32*a*, 32*b* may be attached to the table top 12 when the legs in the collapsed position. Thus, a variety of different configurations are contemplated when table 10 is collapsed, including but not limited to: (1) the support assembly 14 is completely disengaged from table top 12; (2) at least a portion of support assembly is connected to the table top while another portion of the support assembly is disconnected from the table top; and (3) at least a portion of support assembly is permanently coupled to table top.

The legs 32*a*, 32*b* are desirably sized and configured to be connected to any of the desired plurality of leg receiving recesses 48*a*, 48*b*, 48*c*, and 48*d*. In particular, one or both of the legs 32*a*, 32*b* may be sized and configured to be quickly and easily connected and/or disconnected to any desired leg receiving recess. This may allow the legs 32*a*, 32*b*, which are preferably pivotally connected, to pivot or scissor back and forth with respect to one another at a wide variety of angles. This pivotal connection allows the legs 32*a*, 32*b* to be quickly and easily positioned so that the legs can be connected to the desired leg receiving recesses in the table top 12. This pivotal connection also allows the legs 32*a*, 32*b* to be moved between a first or extended position, as shown in FIG. 1, and a second or collapsed position, which is shown in FIGS. 2, 5 and 6. The legs 32*a*, 32*b* desirably fold generally flat and/or adjacent to each other in the second or collapsed position to allow the table 10 to be easily stored or transported.

The table top 12 may also include leg receiving openings to facilitate storing the legs in the collapsed position. For example, as best shown in FIGS. 2 and 3, the table top 12 may include leg receiving openings 50*a*, 50*b*, 52*a*, and 52*b* which are preferably disposed in the lip 30 and sized and configured to allow at least a portion of the legs 32*a*, 32*b* (such as the body portions 36*a*, 36*b*) to extend through the opening when the legs are in the collapsed position.

The leg receiving openings 50*a*, 50*b*, 52*a*, 52*b* may be sized and configured to selectively receive and retain the legs 32*a*, 32*b* in a fixed position. For example, the leg receiving openings 50*a*, 50*b*, 52*a*, 52*b* may receive and retain the legs 32*a*, 32*b* in a fixed position by a snap fit, friction fit, an interference fit or other suitable type of connection. Advantageously, this may allow the legs 32*a*, 32*b* to be quickly and easily stored and released from the collapsed position. It will be appreciated that latches, tabs, locking members, clips, fasteners or the like may also be used to retain the legs 32*a*, 32*b* in the leg receiving openings 50*a*, 50*b*, 52*a*, 52*b* and/or otherwise maintain the legs in the collapsed position.

In greater detail, as shown in FIGS. 2 and 3, the leg receiving openings 50*a*, 50*b* may be sized and configured to receive and/or to be connected to the elongated support members 40*a*, 40*b*. The leg receiving openings 52*a*, 52*b* may be sized and configured to receive and/or to be connected to the elongated support members 40*a*. It will be understood that the the leg receiving openings 50*a*, 50*b*, 52*a*, 52*b* may have other suitable configurations and arrangements depending, for example, upon the configuration of the legs and/or table top 12.

The leg receiving openings 50*a*, 50*b*, 52*a*, 52*b* may include one or more retaining members that may retain the legs 32*a*, 32*b* in a collapsed position. For example, the retaining members may flex or bend slightly to allow the legs 32*a*, 32*b* to be inserted and removed from the leg receiving openings 50*a*, 50*b*, 52*a*, 52*b*. The retaining members preferably resiliently return to their original positions to help secure the legs 32*a*, 32*b* within the leg receiving openings 50*a*, 50*b*, 52*a*, 52*b*. It will be appreciated, however, that the leg receiving openings do not require the use of the retaining members to hold the legs 32*a*, 32*b* within the leg receiving openings 50*a*, 50*b*, 52*a*, 52*b*.

In greater detail, the retaining members may include a lip, tab or the like that extends over a portion of the leg receiving openings 50*a*, 50*b*, 52*a*, 52*b*. The lip may deform or deflect to allow the legs 32*a*, 32*b* to be inserted or removed from the leg receiving openings 50*a*, 50*b*, 52*a*, 52*b*. The lip may include a hollow interior that is formed during the blow-molding process as part of an integral, one-piece structure. It will understand that clips, fasteners and other suitable devices may also be used to secure the legs 32*a*, 32*b* in the collapsed position. The legs 32*a*, 32*b*, however, do not have to be retained in the collapsed position.

The leg receiving openings 50*a*, 50*b* are preferably disposed on one side of the table top 12 and the leg receiving openings 52*a*, 52*b* are preferably disposed on the other side of the table top. This may allow the legs to extend outwardly from one and/or both sides of the table top 12. For example, the openings 50*a*, 50*b* may allow one or both of the legs 32*a*, 32*b* to extend outwardly from one side of the table top and the openings 52*a*, 52*b* may allow one or both of the legs to extend outwardly from the other side of the table top. In particular, the openings 50*a*, 50*b* may allow the legs 32*a*, 32*b* to extend outwardly from one side of the table top 12. In addition, the openings 52*a*, 52*b* may allow one or both of the legs 32*a*, 32*b* to simultaneously extend outwardly from the other side of the table top 12.

The leg receiving openings 50*a*, 50*b*, 52*a*, 52*b* are also preferably sized and configured to allow the table 10 to be stored in a relatively small space. For example, if the legs 32*a*, 32*b* are disposed generally parallel to the table top 12 in the storage position, then the required storage space may be minimized. This may facilitate stacking of the tables if the legs 32*a*, 32*b* are generally parallel to and aligned with the table top 12. Thus, the leg receiving openings 50*a*, 50*b*, 52*a*, 52*b* may allow the legs 32*a*, 32*b* to be disposed generally adjacent to the bottom surface 18 of the table top 12 when the legs are in the collapsed position. More specifically, as shown in FIG. 2, the leg receiving openings 50*a*, 50*b*, 52*a*, 52*b* may allow the body portions 36*a*, 36*b* to be disposed generally adjacent and/or generally parallel to the bottom surface of the recessed center section 28. Also, the leg receiving openings 50*a*, 50*b*, 52*a*, 52*b* openings may help allow some or all of the legs to be disposed between a plane generally aligned with the top 16 of the table top 12 and a plane generally aligned with a lower portion of the lip 30

In particular, as best seen in FIGS. 2 and 3, the lip 30 may have a lower surface 54 that is located proximate the bottom 18 of the table top 12. As best shown in FIGS. 2 and 4-8, when the legs 32*a*, 32*b* are in the collapsed position, all or a portion of the lower portions 34*a*, 34*b* of the legs may be positioned between the upper surface 16 and the lower surface 54 of the lip 30. Similarly, all or a portion of the upper portions 38*a*, 38*b* of the legs may be positioned between the upper surface 16 and the lower surface 54 of the lip 30. Likewise, all or a portion of the body portions 36*a*, 36*b* of the legs 32*a*, 32*b* may be positioned between the upper surface 16 and the lower surface 54 of the lip 30 when the legs are in the collapsed position. Further, all or a portion of the support portions 40*a*, 40*b* may be positioned between the upper surface 16 and the lower surface 54 of the lip 30 when the legs are in the collapsed position.

As best shown in FIGS. 2 and 3, center portions 56, 58 may be disposed between the leg receiving openings 50*a*, 50*b* and 52*a*, 52*b*, respectively. If desired, the center portions 56, 58 may be sized and configured to help secure the legs in the collapsed position. The center portions 56, 58 may also be for aesthetic or design reasons. The center portions 56, 58 may also be omitted, if desired. It will be appreciated that the size and configuration of the center portions 56, 58 may depend upon the size and configuration of the leg receiving openings 50*a*, 50*b*, 52*a*, 52*b*.

The support assembly 14 may be configured to increase the legroom for the user when table 10 is in an upright position. For example, as shown in FIGS. 2 and 4, the body portions 36*a*, 36*b* are not centered with the lower portions 34*a*, 34*b* or upper portions 38*a*, 38*b* of legs 32*a*, 32*b*. Instead, the body portions 36*a*, 36*b* are disposed towards an end of the lower portions 34*a*, 34*b* and upper portions 38*a*, 38 of legs 32*a*, 32*b*. Thus, when the table top 12 is coupled to the support assembly 14, as shown in FIG. 2 for example, the body portions 36*a*, 36*b* are located proximate the rear 22 of the table top 12. Therefore, when the user is seated at front 20 of table 10, the body portions 36*a*, 36*b* of the legs 32*a*, 32*b* are positioned farther away from the user so as to avoid impeding the user's space.

In particular, because the body portions 36*a*, 36*b* of the legs 32*a*, 32*b* may be positioned near the rear 22 of table top 12, the user can slide the table 10 closer to their body. This allows the user to position the table top 12 in a desired position while still maintaining adequate legroom underneath the table 10. Thus, it can be seen that table 10 facilitates the ergonomic comfort of the user by reducing the need of the user to lean forward over the table in order to perform a particular task, such as reading or crafting. The offset body portions 36*a*, 36*b* also allow the user to slide a chair under the table 10 such that the support assembly 14 does not generally interfere with the chair. It will be appreciated, however, that the body portions 36*a*, 36*b* may be located in any suitable relation to the lower portions 34*a*, 34*b* and/or upper portions 38*a*, 38*b* of the legs 32*a*, 32*b*.

As shown in FIGS. 2 and 3, a plurality of depressions 60 may be formed in the bottom 18 of the table top 12. The depressions 60 are preferably sized and configured to provide additional structural support and integrity to table top 12. The depressions 60 may cover a substantial portion of the bottom 18 of the table top 12 or the depressions may cover only a portion of the bottom of table top. The depressions 60 may also be located in the lip 30 and/or any leg receiving opening or recess, if desired. Alternatively, the table top 12 can be constructed without any depressions 60. In addition, while the depressions 60 are preferably located in the bottom 18, it will be appreciated that depressions may also be formed in any desired portion of the table top 12.

As shown in FIGS. 2 and 3, the depressions 60 may be formed in an array. The depressions 60 in the array may be located in a staggered, geometric, random or other suitable pattern. Additionally, the depressions 60 may extend from one surface to an opposing surface such that an end of the depression contacts or engages the opposing surface. The depressions 60 may also extend only a portion of the distance between the opposing surfaces and may be spaced apart from an opposing surface. For example, the depressions 60 may extend from the bottom 18 to the top 16, but the depressions may also extend only a portion of the distance between the bottom and top portions of the table top 12.

The depressions 60 may be designed to increase the strength and structural integrity of the table 12. While it was previously believed that stronger structures were provided by making the walls thicker and/or adding structures such as ribbing, the depressions 60 may provide the surprising and unexpected result that an increased number of depressions may provide a stronger structure and/or thinner walls may be used to construct the structure. Surprisingly, the depressions 60 may increase the structural integrity of the structure despite forming disruptions in the continuity of bottom portion 18 of the table top 12, and less plastic can be used to make the structure even though the plurality of depressions are formed in the structure. The costs of manufacturing and transportation may be decreased because thinner plastic walls may be used to construct the table top 12, which may create a lighter weight table 10.

Additionally, when blow-molded structures are formed, a certain amount of time must elapse before the structure can be removed from the mold. Blow-molded structures with thicker walls require a longer cooling time than structures with thinner walls. The depressions 60, however, may allow table tops with thinner plastic walls to be constructed and that reduces the cooling time before the structure can be removed from the mold. Significantly, a reduced cycle time may increase the efficiency of manufacturing process. In addition, because less plastic is required, the cost of the table 10 may be reduced.

The leg receiving openings 50*a*, 50*b*, 52*a*, and 52*b*; the leg receiving recesses 48*a*, 48*b*, 48*c*, and 48*d*; and/or the depressions 60 may be formed integrally with table top 12 during the manufacturing process as part of a one-piece structure. For example, one or more of these features may be formed during a blow-molding process. Advantageously, this allows a strong, lightweight structure to be created. It will be appreciated, however, that these features do not have to be formed as part of a unitary structure and these features can be formed separately or after the manufacturing process.

As best seen in FIG. 2, a first leg 32*a* is preferably selectively connected to one or the leg receiving recesses 48*a*, 48*b*, 48*c* disposed near the one side of the table top 12 and the second leg 32*b* is preferably securely connected to the table top in a generally fixed position to the leg receiving recess 48*d*. For example, as shown in FIG. 1, the leg 32*a* may be connected to the leg receiving recess 48*a* and the leg 32*b* may be connected to the leg receiving recess 48*d*. Because the first leg 32*a* may be selectively connected to any suitable receiving recess, the height of the table 10 may be adjusted. For example, if the first leg 32*a* is connected to the receiving recess 48*c* disposed proximate the center of the table top 12, then the table 10 will have a first height such as twenty-eight inches. On the other hand, if the first leg 32*a* is connected to the receiving recess 48*a* disposed proximate the left side 26, then the table 10 will have a second height such as twenty-one inches. Of course, the first leg 32*a* could also be connected to any number of receiving recesses to create a table 10 with any combination of suitable heights, such as, twenty-one, twenty-four, twenty-six, and/or twenty-eight inches. It will be appreciated that the table 10 could be sized and configured to have any suitable height and the table may include any desired number of receiving recesses to allow the height of the table to be adjusted. While the first leg 32*a* is preferably selectively connected to the table top 12 and the second leg 32*b* is preferably securely connected to the table top 12, it will be appreciated that the second leg may be selectively connected to the table top and the first leg may be securely connected to the table top. It will also be appreciated that the first and second legs 32*a*, 32*b* may be selectively secured to the table top 12 if desired.

In addition, the second leg 32*b* may be securely connected to the table top 12 and the first leg 32*a* may be selectively connected to the table top. In particular, the first leg 32*a* may be selectively connected to any suitable leg receiving recesses 48*a*, 48*b*, 48*c* according to the desired height of the table. In order to adjust the height of the personal table 10, the first leg 32*a* may be removed from its leg receiving recess and inserted into another desired leg receiving recess. In order to collapse the table 10, the first leg 32*a* is removed from its leg receiving recess and the legs 32*a*, 32*b* are positioned in the collapsed position shown in FIG. 2. Advantageously, the legs 32*a*, 32*b* may extend through the leg receiving openings 50*a*, 50*b*, 52*a*, and 52*b* may be retained in the collapsed position in any suitable fashion. When it is desired to use the table 10, the legs 32*a*, 32*b* are removed from the leg receiving openings 50*a*, 50*b*, 52*a*, and 52*b* and the first leg 32*a* is inserted into a desired leg receiving recesses 48*a*, 48*b*, 48*c*. It will be appreciated that the entire support assembly 14 can be removed when both legs 32*a*, 32*b* are both selectively attached to the table top 12.

It will be appreciated that the leg receiving recesses 48*a*, 48*b*, 48*c*, and 48*d* may also be disposed along the width of table top 12. That is, the leg receiving recesses 48*a*, 48*b*, 48*c*, and 48*d* may be disposed proximate the right and left sides 24, 26 of the table top 12. Advantageously, this may provide additional uses for the personal table 10. Further, if desired, the leg receiving recesses the leg receiving recesses 48*a*, 48*b*, 48*c*, and 48*d* may be disposed along the length and/or width of the table top 12 depending, for example, upon the intended use of the table 10.

Figure 9:
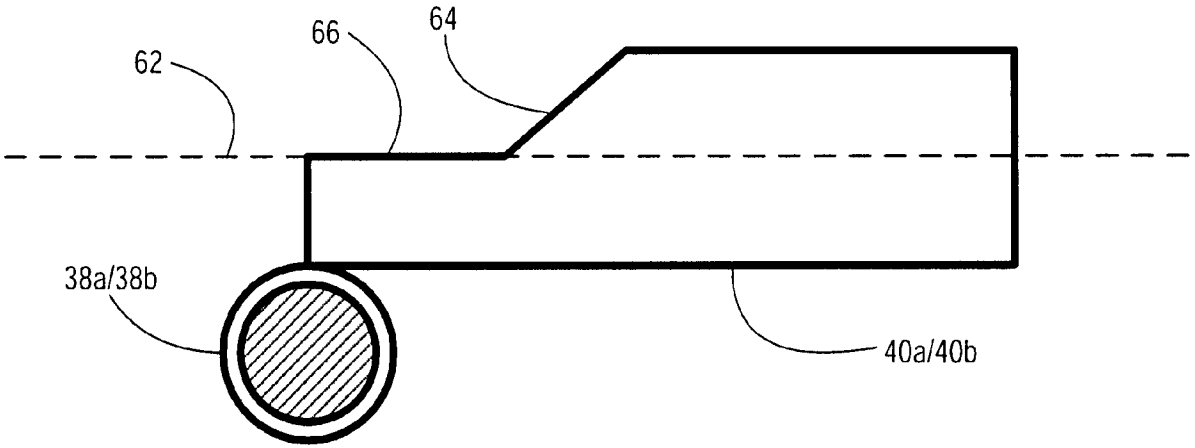
FIG. 9 is a side view of a portion of the support assembly shown in FIG. 4.
Figure 10:
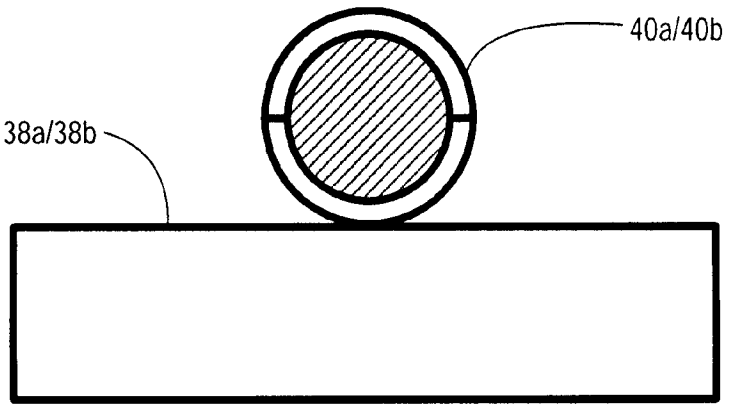
FIG. 10 is a side view of another portion of the support assembly shown in FIG. 4.

As mentioned above, the legs may include a body portion, a lower portion, and an upper portion. In one embodiment, the body portion may be offset with respect to an upper portion. For example, as shown in FIGS. 9 and 10, one or more of the support members 40*a* may be connected to (or formed integrally with) the upper portion 38*a* in an offset relationship; and one or more of the support members 40*b* may be connected to (or formed integrally with) the upper portion 38*b* in an offset relationship. In one embodiment, a support member (such as, the support members 40*a*, 40*b*) may be offset with respect to an upper portion of a leg (such as, the upper portions 38*a*, 38*b*) such that the support member is generally tangent to the upper portion of the leg, as shown in FIG. 9. In one embodiment, a support member may be offset with respect to an upper portion of a leg such that a generally central axis of the support member is positioned outside of the upper portion. For example, as shown in FIGS. 9 and 10, the support members 40*a*, 40*b* may have a generally central axis 62, which is respectively positioned outside of (and does not intersect) the upper portions 38*a*, 38*b*. Of course, a support member may be offset with respect to an upper portion of a leg in any other suitable fashion, but a support member need not be offset with respect to an upper portion of a leg.

Positioning a body portion of a leg in an offset configuration with respect to an upper portion of a leg may help to provide a more compact personal table 10, when in a collapsed position best shown in FIGS. 2 and 4-8. This may reduce the required amount of storage space for a table and may significantly increase the number of personal tables that may be shipped in standard shipping containers. Further, the collapsed position may facilitate stacking of the tables. For example, an offset configuration may help allow one or both of the legs 32*a*, 32*b* to be disposed generally adjacent to the bottom surface 18 of the table top 12 when the legs are in the collapsed position. More specifically, as shown in FIG. 2, an offset configuration may help allow one or both of the body portions 36*a*, 36*b* to be disposed generally adjacent and/or generally parallel to the bottom surface of the recessed center section 28. Also, as an example, an offset configuration may help allow one or more portions of some or all of the legs to be disposed below the top 16 of the table top 12, above a bottom 18 of the table top 12, or both. As shown in FIGS. 2 and 3, the lip 30 may have a lower surface 54 at or proximate the bottom 18 of the table top 12. As best shown in FIGS. 2 and 4-8 with the legs 32*a*, 32*b* in the collapsed position, all or a portion of the lower portions 34*a*, 34*b* may be positioned below the upper surface 16, above the lower surface 54 of the lip 30, or both (that is, between the upper surface 16 and the lower surface 54 of the lip 30). Similarly, all or a portion of the upper portions 38*a*, 38*b* may be positioned below the upper surface 16, above the lower surface 54 of the lip 30, or both. Likewise, all or a portion of the body portions 36*a*, 36*b* may be positioned below the upper surface 16, above the lower surface 54 of the lip 30, or both. Further, all or a portion of the support portions 40*a*, 40*b* may be positioned below the upper surface 16, above the lower surface 54 of the lip 30, or both.

Figure 7:
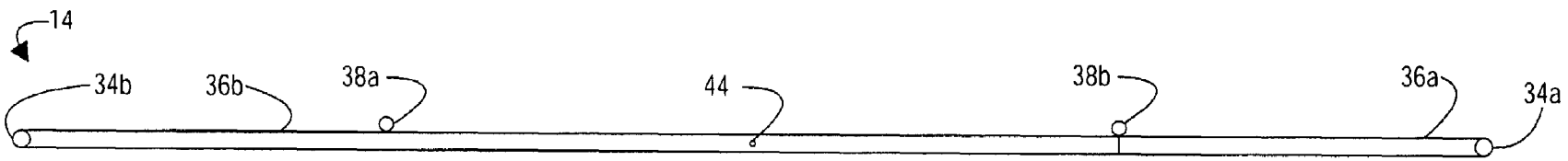
FIG. 7 is a front view of a portion of the personal table shown in FIG. 1, illustrating the support assembly.
Figure 8:
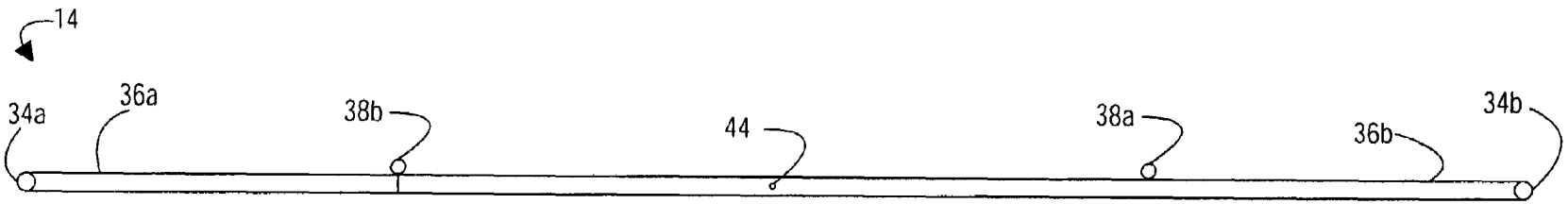
FIG. 8 is a rear view of the portion of the personal table shown in FIG. 7.

Positioning a body portion of a leg in an offset configuration with respect to an upper portion may help to provide a more compact support assembly 14, when in a collapsed position best shown in FIGS. 4 and 7-8. A more compact support assembly may also help provide a more compact table 10, which may (as discussed above) increase shipping efficiency and/or storage efficiency. For example, as best shown in FIGS. 7 and 8 with the body portions 36*a*, 36*b* in offset configuration, the body portion 36*a* and the body portion 36*b* may be generally aligned. More desirably, the body portion 36*a* and the body portion 36*b* may be generally aligned such that the central axes of the body portion 36*a* and the body portion 36*b* may be generally in the same plane—thus providing a more compact support assembly 14.

It will be appreciated that a body portion of a leg may be configured in an offset relationship with respect to an upper portion of the leg, a lower portion of the leg, or both. Also, it will be appreciated that an offset configuration for a body portion of a leg, although advantageous, is optional and that the table 10 does not require that a body portion of a leg be in any offset configuration.

The support members 40*a*, 40*b* may include a tapered end with a generally sloped edge 64 that tapers to a generally flat edge 66. Of course, the support members 40*a*, 40*b* may have any other suitable configuration.

Figure 11:
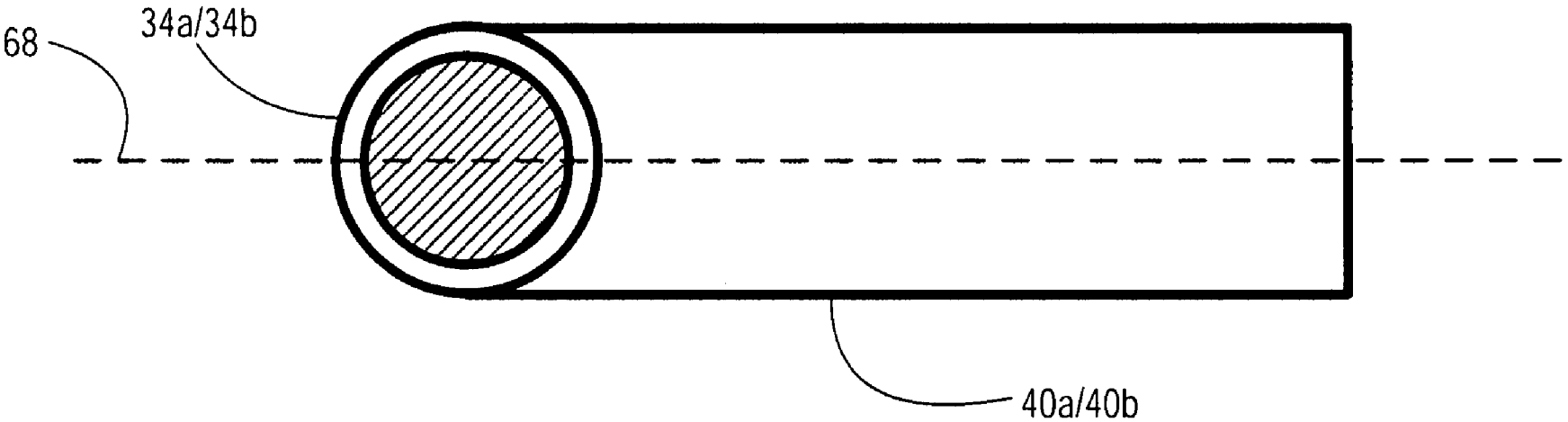
FIG. 11 is a side view of still another portion of the support assembly shown in FIG. 4.

As best shown in FIGS. 7, 8 and 11, when the support assembly 14 is an a collapsed position, the support portions 40*a*, 40*b* and the lower portions 34*a*, 34*b* may be generally aligned. More desirably, the support portions 40*a*, 40*b* and the lower portions 34*a*, 34*b* may be generally aligned such that the central axes of the support portions and the lower portions may be generally in the same plane 68—thus providing a more compact support assembly 14. Of course, the support portions 40*a*, 40*b* and the lower portions 34*a*, 34*b* need not be aligned in any fashion.

From the foregoing description, the leg receiving recesses the leg receiving recesses 48*a*, 48*b*, 48*c*, and 48*d* allow the personal table 10 to be readily adjusted to various suitable heights. For example, the personal table 10 may be configured to have one or more heights, such as, for example, a maximum height, one or more intermediate heights, and a minimum height. Thus, the table 10 may be configured to have a height that enables a user to stand and utilize the table, a height that is generally equal to the height of a counter top, and/or a height that enables the user to be seated at the table. Additionally, the height of the table 10 may be adjusted according to the desired use of the table. For example, the height of the table may be adjusted to allow the table to be used by children, or the table may have a height which allows it to be used as a television tray or table. Significantly, the various heights of table 10 can be predetermined and designed for any suitable purpose. This provides great flexibility and a wide variety of uses for table 10.

Significantly, the various heights of the table can be predetermined and designed for any suitable purpose. This provides great flexible and a wide variety of uses for the table. Further, the legs can be connected to the table top by any suitable type of support structure.

One skilled in the art will also appreciate that although the exemplary embodiments discussed above have been described with respect to tables, these aspects and features may also be used in connection with other types of furniture such as chairs, stools, footstools, or any other suitable type of devices or fixtures.

Although this invention has been described in terms of certain preferred embodiments, other embodiments apparent to those of ordinary skill in the art are also within the scope of this invention.

What is claimed is:

1. A personal table that is intended to be used by a single user, the personal table comprising:

a table top constructed from blow-molded plastic, the table top including an upper portion, a lower portion and a hollow interior portion formed during the blow-molding process, the upper portion, the lower portion and the hollow interior portion being integrally formed as part of a unitary, one-piece structure during the blow-molding process;

a first leg receiving recess at least partially defined by the lower portion of the table top, the first leg receiving recess being integrally formed on a first side of the table top as part of the unitary, one-piece structure during the blow-molding process;

a second leg receiving recess at least partially defined by the lower portion of the table top, the second leg receiving recess being integrally formed on a second side of the table top as part of the unitary, one-piece structure during the blow-molded process;

a single support assembly that is sized and configured to support the table top above a surface, the single support assembly being capable of moving between an extended position and a collapsed position, the single support assembly including only two leg support portions, the single support assembly comprising:

a first leg support portion constructed from metal, the first leg support portion including an upper section and a body section; and a second leg support portion constructed from metal, the second leg support portion including an upper section and a body section, the first leg support portion and the second leg support portion being pivotally connected, the first leg support portion and the second leg support portion having a generally X-shaped configuration in the extended position;

a first opening disposed on the first side of the table top that is sized and configured to receive a portion of the first leg support portion when the single support assembly is in the collapsed position; and a second opening disposed on the first side of the table top that is sized and configured to receive a portion of the second leg support portion when the single support assembly is in the collapsed position;

wherein at least one leg support portion is selectively connected in more than one fixed position relative to the table top to allow the height of the table to be adjusted when the single support assembly is in the extended position; and wherein at least one leg support portion is selectively connected to the table top to allow the single support assembly to be moved between the extended and collapsed positions.

2. The personal table as in claim 1, wherein the single support assembly is disposed between a first plane aligned with the upper portion of the table top and a second plane aligned with the lower portion of the table top when the single support assembly is in the collapsed position.

3. The personal table as in claim 1, wherein the upper section of the first leg support portion, the body section of the first leg support portion, the upper section of the second leg support portion, and the body section of the second leg support portion are disposed between a first plane aligned with the upper portion of the table top and a second plane aligned with the lower portion of the table top when the single support assembly is in the collapsed position.

4. The personal table as in claim 1, wherein the first leg support portion further includes a lower section; wherein the second leg support portion further includes a lower section; and wherein the upper section of the first leg support portion, the body section of the first leg support portion, the lower section of the first leg support portion, the upper section of the second leg support portion, the body section of the second leg support portion, and the lower section of the second leg support portion are disposed between a first plane aligned with the upper portion of the table top and a second plane aligned with the lower portion of the table top when the single support assembly is in the collapsed position.

5. A personal table that is intended to be used by a single user, the personal table comprising:

a table top constructed from blow-molded plastic, the table top including an upper portion, a lower portion and a hollow interior portion formed during the blow-molding process, the upper portion, the lower portion and the hollow interior portion being integrally formed as part of a unitary, one-piece structure during the blow-molding process;

a first leg receiving recess at least partially defined by the lower portion of the table top, the first leg receiving recess being integrally formed on a first side of the table top as part of the unitary, one-piece structure during the blow-molding process;

a second leg receiving recess at least partially defined by the lower portion of the table top, the second leg receiving recess being integrally formed on a second side of the table top as part of the unitary, one-piece structure during the blow-molded process; and a single support assembly that is sized and configured to support the table top above a surface, the single support assembly being capable of moving between an extended position and a collapsed position, the single support assembly including only two leg support portions, the single support assembly comprising:

a first leg support portion including only a single leg with an upper section and a body section; and a second leg support portion including only a single leg with an upper section and a body section, the first leg support portion and the second leg support portion being pivotally connected, the first leg support portion and the second leg support portion having a generally X-shaped configuration in the extended position;

the upper section of the first leg support, the body section of the first leg support, the upper section of the second leg support, and the body section of the second leg support being disposed between a first plane aligned with the upper portion of the table top and a second plane aligned with the lower portion of the table top when the single support assembly is in the collapsed position.

6. The personal table as in claim 5, wherein the first leg support portion further includes a lower section; wherein the second leg support portion further includes a lower section; and wherein the lower section of the first leg support portion and the lower section of the second leg support portion are disposed between the first plane and the second plane when the single support assembly is in the collapsed position.

7. The personal table as in claim 5, wherein at least one leg support portion is selectively connected in more than one fixed position relative to the table top to allow the height of the table to be adjusted when the single support assembly is in the extended position; and wherein at least one leg support portion is selectively connected to the table top to allow the single support assembly to be moved between the extended and collapsed positions.

8. A personal table that is intended to be used by a single user, the personal table comprising:

a table top constructed from blow-molded plastic, the table top including an upper portion, a lower portion and a hollow interior portion, the upper portion, the lower portion and the hollow interior portion being integrally formed as part of a unitary, one-piece structure during the blow-molding process;

a first leg receiving recess at least partially defined by the lower portion of the table top, the first leg receiving recess being integrally formed on a first side of the table top as part of the unitary, one-piece structure during the blow-molding process;

a second leg receiving recess at least partially defined by the lower portion of the table top, the second leg receiving recess being integrally formed on a second side of the table top as part of the unitary, one-piece structure during the blow-molded process;

a single support assembly that is sized and configured to support the table top above a surface, the single support assembly being capable of moving between an extended position and a collapsed position, the single support assembly including only a first leg and a second leg;

a first opening disposed on the first side of the table top that is sized and configured to allow a portion of the first leg to extend through the first opening when the support assembly is in the collapsed position; and a second opening disposed on the second side of the table top that is sized and configured to allow a portion of the second leg to extend through the second opening when the support assembly is in the collapsed position;

wherein the first leg and the second leg are disposed in a generally X-shaped configuration when the single support assembly is in the extended position; and wherein the first leg and the second leg are at least substantially disposed between a first plane aligned with the upper portion of the table top and a second plane aligned with the lower portion of the table top when the single support assembly is in the collapsed position.

9. The personal table as in claim 8, wherein the first leg is selectively connected in more than one fixed position relative to the table top to allow the height of the table to be adjusted when the single support assembly is in the extended position.

10. The personal table as in claim 8, wherein a portion of the first leg and a portion of the second leg extend through the first opening when the single support assembly is in the collapsed position.

11. The personal table as in claim 8, wherein a portion of the second leg extends outwardly from the first side of the table top and the second side of the table top when the single support assembly is in the collapsed position.

12. The personal table as in claim 8, wherein the first opening and the second opening are disposed on opposing sides of the table top.

13. The personal table as in claim 8, further comprising a first pair of openings disposed on the first side of the table top and a second pair of openings disposed on the second side of the table top, the first pair of openings being sized and configured to receive two elongated support members of the first leg and the second pair of openings being sized and configured to receive two elongated support members of the second leg when the single support assembly is in the collapsed position.

14. The personal table as in claim 8, wherein the first opening is disposed in a lip of the table top and the second opening is disposed in the lip of the table top.

15. The personal table as in claim 8, wherein the first leg is generally parallel to the second leg when the single support assembly is in the collapsed position.

16. The personal table as in claim 8, wherein the first leg is generally parallel to the lower portion of the table top and the second leg is generally parallel to the lower portion of the table top when the single support assembly is in the collapsed position.

* * * * *

UNITED STATES PATENT AND TRADEMARK OFFICE

CERTIFICATE OF CORRECTION

PATENT NO. : 7,475,640 B2
APPLICATION NO. : 11/372966
DATED : January 13, 2009
INVENTOR(S) : Winter et al.

It is certified that error appears in the above-identified patent and that said Letters Patent is hereby corrected as shown below:

Title Page

Item 63, Related U.S. Application Data, change "now Pat. No. 7,263,932, and a continuation-in-part of" to --now Pat. No. 7,263,932, which is a continuation of--

Item 63, Related U.S. Application Data, change "now Pat. No. 6,912,961, which is" to --now Pat. No. 6,912,961, which is a continuation-in-part of application No. 29/167,628, filed on Sep. 18, 2002, now Pat. No. Des. 469,996, and--

Item 63, Related U.S. Application Data, change "application No. 11/372,966, which is a continuation-in-part of application No. 10/692,892" to --and a continuation-in-part of application No. 10/692,892--

Item 63, Related U.S. Application Data, change "now Pat. No. 7,059,256" to --now Pat. No. 7,059,254--

Title Page 2

Item 56, References Cited, Other Publications, change "Blow Mold Products/Outdoor Products, Dongguan Shichang Metals Factory Co., Ltd., 4 pages, Date Unkown (copyright notice includes the years 2002-2003)." to --Blow Mold Products/Outdoor Products, Dongguan Shichang Metals Factory Co., Ltd., 4 pages, Date Unknown (copyright notice includes the years 2002-2003).--

Figures

Figure 7, replace the figure with the figure herein depicted wherein the reference 44 has been changed to the reference 46.

Signed and Sealed this
Second Day of August, 2011

David J. Kappos

David J. Kappos
*Director of the United States Patent and Trademark Office*

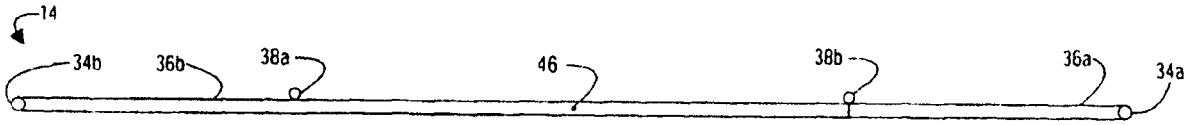

FIGURE 7

Figure 8, replace the figure with the figure herein depicted wherein the reference 44 has been changed to the reference 46.

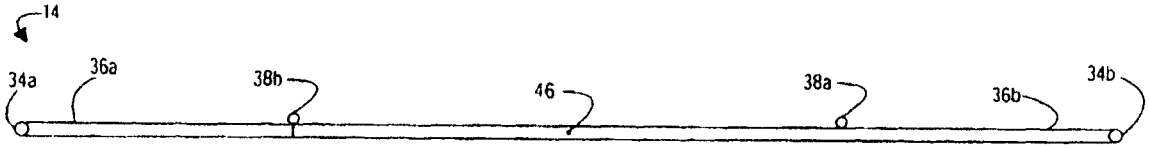

FIGURE 8

Column 1
Lines 20-21, change "Ser. No. 60/421,221, filed Oct. 25, 2002, entitled PERSONAL TABLE" to --Ser. No. 60/421,221, filed Oct. 25, 2002, entitled TABLE--
Lines 32-33, change "now U.S. Pat. No. 7,059,256" to --now U.S. Pat. No. 7,059,254--

Column 3
Line 67, change "support" to --supported--

Column 4
Line 3, change "the table top is support by a single pair of legs, that may" to --the table top is supported by a single pair of legs, it may--

Column 5
Line 29, change "increase flexibly" to --increased flexibility--

Column 6
Line 10, change "any" to --many--
Line 15, change "attached a lip" to --attached to a lip--

Column 9
Line 65, change "a recessed a center section" to --a recessed center section--

Column 12
Line 5, change "preferably may generally the" to --preferably may be generally the--

Column 15
Line 55, change "upper portions 38a, 38" to --upper portions 38a, 38b--

Column 17
Line 48, change “may be retained” to --and may be retained--
Line 62, delete “the leg receiving recesses”

Column 19
Line 24, delete “the leg receiving recesses”
Line 42, change “great flexible” to --great flexibility--